US006092830A

United States Patent [19]

Wheeler

[11] Patent Number: 6,092,830

[45] Date of Patent: Jul. 25, 2000

[54] RELEASE BINDING FOR TELEMARK AND CROSS-COUNTRY SKIS

[76] Inventor: Bryce Wheeler, P.O. Box 3802, Mammoth Lakes, Calif. 93546

[21] Appl. No.: 09/094,880

[22] Filed: Jun. 15, 1998

[51] Int. Cl.[7] ..... A63C 9/08

[52] U.S. Cl. ..... 280/624; 280/634

[58] Field of Search ..... 280/14.2, 613, 280/614, 615, 623, 624, 633, 634, 636, 637; 441/70; 279/79, 24

[56] References Cited

U.S. PATENT DOCUMENTS

| | | | |
|---|---|---|---|
| 1,809,237 | 6/1931 | Halborg | 279/24 |
| 3,775,866 | 12/1973 | Marker | 280/613 |
| 3,931,980 | 1/1976 | Marker | 280/623 |
| 4,185,851 | 1/1980 | Salomon | 280/613 |
| 4,505,493 | 3/1985 | Gustavsson | 280/624 |
| 4,787,278 | 11/1988 | Bononi | 279/79 |
| 5,076,604 | 12/1991 | Wittmann et al. | 280/633 |
| 5,481,949 | 1/1996 | Yen | 279/79 |
| 5,823,563 | 10/1998 | Dubuque | 280/615 |
| 5,913,530 | 6/1999 | Berger et al. | 280/613 |

FOREIGN PATENT DOCUMENTS

| | | | |
|---|---|---|---|
| 961064 | 1/1975 | Canada | 280/613 |
| 810088 | 3/1937 | France | 280/615 |
| 2706004 | 8/1978 | Germany | 280/613 |
| 113817 | 4/1945 | Sweden | 280/615 |

*Primary Examiner*—J. J. Swann
*Assistant Examiner*—F. B. Vanaman
*Attorney, Agent, or Firm*—Timothy Thut Tyson; Freilich, Hornbaker & Rosen

[57] ABSTRACT

A release binding (20) is shown for releasably attaching a ski boot to a telemark or cross-country ski (22). A load spool (50) having a circumferential groove (56) is attached perpendicular to the bottom of a standard toe plate (24) used to secure the toe of the boot. A release plate (40) having a planar load spring (44) inside is attached to the ski. The load spring has two sides (62, 64) attached together at both ends forming an elongated aperture. To assemble the boot on the ski, the skier orients the load spool through a hole (48) in the top of the release plate into the elongated aperture of the spring and pushes down. A pilot surface (60) on the load spool pushes the two sides of the spring apart until the groove is reached whereupon the two spring sides snap into the groove retaining the toe plate on the ski.

15 Claims, 6 Drawing Sheets

RELEASE BINDING FOR TELEMARK AND CROSS-COUNTRY SKIS

TECHNICAL FIELD

The present invention relates generally to the field of ski bindings, and more particularly to a release binding for telemark and cross-country skis.

BACKGROUND ART

A downhill ski binding for holding a boot to the ski has releases at both the toe and heel which release the boot from the ski when predetermined forces have been reached. The toe binding releases when the fall or force is to the side. The heel binding releases when the fall or force is toward the front. The toe and heel bindings are at a fixed distance from each other and operate with a stiff downhill boot having a rigid sole. The stiff boot rigidly attached to the ski provides the control necessary for the skier to manipulate the ski. But the rigid attachment between the boot and the ski can cause trouble during a fall when forces are magnified by the leverage of the long ski. And, the chances for the skier getting into trouble are enhanced in downhill skiing by the fast speeds, which increase the forces encountered in falls, and crowded slopes where the skier is surrounded by skiers and snowboarders of varying skill levels, which increase the likelihood of collisions and need for sudden evasive action to avoid collisions. Release bindings are therefore essential to protect the legs of the skier.

In contrast, cross-country skiing is more gentle because the speeds are usually slower, the terrain is usually gently sloping, and there are fewer other skiers in the vicinity. The cross-country boot is not rigidly attached to the ski. It is only attached at the toe allowing the heel to rise off the ski as the skier strides along. The boot is flexible and usually has a sole with three holes across the toe which couple to three pins on the ski. This arrangement is flexible and provides some protection for the skier during a fall. Instead of the ski being rigidly attached to the boot as on a downhill ski, the heel of the boot can move away from the ski during a fall thereby substantially lessening the chances for injury to the leg.

A similar arrangement is found on a telemark ski which is similar to a cross-country ski but is also useful on downhill slopes. The telemark ski is shorter for a given skier than a cross-country ski making it easier to turn. Because the skier requires a given surface area to support his weight, the telemark ski is slightly wider than the cross-country ski to compensate for the decrease in length. The binding and boot arrangement of the telemark ski are similar to the cross-country ski with the three pin system being common.

Even though cross-country and telemark skis may be considered safer than downhill skis, injuries still occur. The increasing use of plastic boots instead of leather boots has helped reduce the injury rate somewhat. Some releasable bindings have become available but they are not widely used. An improved releasable binding for cross-country and telemark skiers would therefore be of value.

A release ski binding for downhill and cross-country skis is shown in U.S. Pat. No. 3,877,712 utilizing torsion bars on each side of the boot to control levers engaging the heel of the boot. The entire ski binding assembly rotates up around the toe when the skier desires to raise the heel for cross-country use.

U.S. Pat. No. 4,348,036 shows a safety binding for nordic skis which features a cylindrical structure mounted across the front of a boot having cupped rotation surfaces at each end. A releasable binding is mounted on the ski having two arms each with a ball member on the end facing the cupped rotation surfaces on the ski. The boot rotates up and down around its toe on the ball members. When unusual forces are encountered, a spring which holds the arms in place allows them to spread apart thereby releasing the ball members from the ends of the cylinder on the boot.

A similar arrangement is seen in U.S. Pat. No. 4,621,828 which shows a safety binding for nordic skis. Instead of moving arms, a rigid bracket is mounted on the ski having the cupped rotation members. A cylinder mounted transverse to the toe of the boot has a spring which pushes out two ball ends into the cupped rotation members. As in U.S. Pat. No. 4,348,036, the boot rotates up and down around its toe on the ball members. When unusual forces are encountered, the ball ends push in against the spring releasing the boot from the ski.

U.S. Pat. No. 5,518,264 discloses a free heel/anterior release binding utilizing a cable. A rocker means at the heel of the boot rotates under sufficient stress to cause the effective lengthening of the cable relative to the length of the boot allowing the boot to slip free.

The most widely used telemark release bindings commercially available are the CRB 3-pin cable and the CRB classic cable models available from Voile of Salt Lake City, Utah. Both feature a release plate on which either the 3-pin cable or classic cable mounts are attached. The boot is secured in either of these arrangements around the heel by a cable. The mount and release plate remain with the boot. The rear of the release plate features a semicircular indentation which abuts a semicircular friction pad that is permanently attached to the ski. The front of the release plate has a shallow ball type socket perpendicular to the bottom of the release plate and facing toward the front of the ski. Mounted on the ski in front of the ball type socket is a spring in a barrel having a ball end facing the ball socket. The skier engages the ski by placing the rear of the release plate against the friction pad on the ski and then pushing the toe down against the barrel forcing the ball end into the barrel until the ball end engages the ball type socket. When unusual backward forces are encountered, the release plate pushes the ball end against the spring releasing the binding. Unusual forward forces do not insure release in this release mechanism because the release plate remains engaged with the semicircular friction pad.

DISCLOSURE OF INVENTION

The present invention is directed to an improved release binding for telemark and cross-country skis. Instead of fastening the toe plate directly to the ski, a release plate is positioned between a toe plate and the ski. Inside the release plate is a planar load spring having two sides forming an elongated central aperture which is accessible through a top hole. A load spool having a circumferential groove is attached to the bottom of the toe plate. To install the toe plate on the ski, the skier positions the load spool in the hole in the release plate and pushes down with his weight to engage the groove of the load spool in the spring. The resulting release binding thereby securely holds the toe plate to the ski during normal skiing conditions while adding very little weight or height to the position of the boot above the ski.

If the skier falls down or otherwise subjects the release binding to unusual conditions, the load spool is pulled up against the resilience of the load spring. If the force is not sufficient to entirely displace the groove in the load spool from the spring, the resilience of the spring returns the toe plate to a secure position on the ski. If, however, the force pulls the load spool entirely out of the load spring, the skier is released from the ski thereby avoiding injury.

In accordance with a preferred embodiment of the invention, an adapter plate is provided for adapting unmodified toe plates for use with the release plate.

In accordance with an important aspect of the invention, a pilot surface is provided on the load spool which has increasing diameters as the groove is approached for pushing the sides of the load spring apart as the load spool is inserted in the spring.

In accordance with a preferred embodiment of the invention, three conical guides nest in three coaxial countersinks to provide a means for orienting the toe plate on the ski. The conical guides provide a camming action aiding in the release of the load spool from the load spring during a fall.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
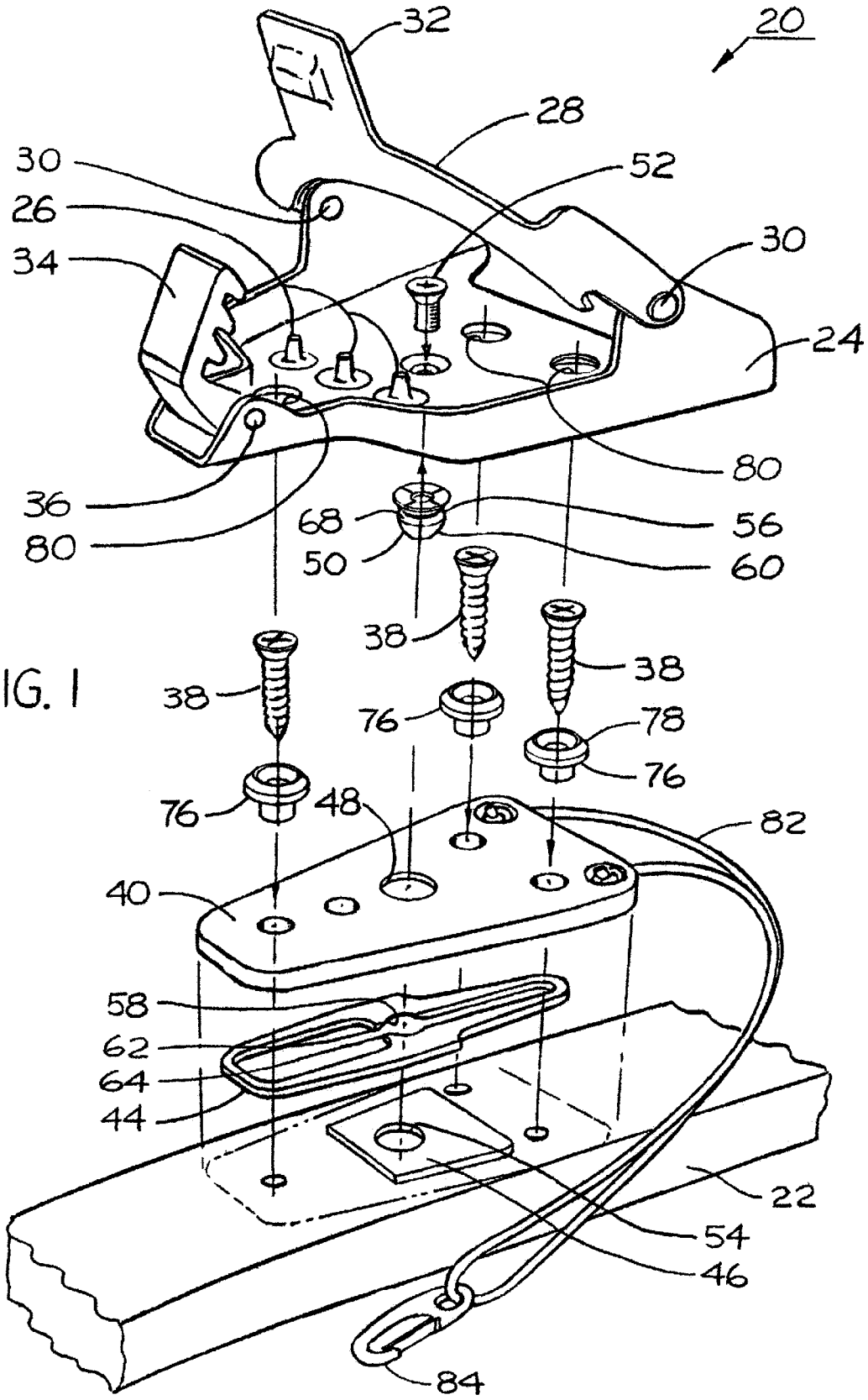
FIG. 1 is an exploded top front left side perspective view of a release binding in accordance with the present invention above a central portion of a ski.

Referring initially to FIG. 1, there is illustrated an exploded top front left side perspective view of a release binding in accordance with the present invention, generally designated as 20, above a central portion of a cross-country or telemark ski 22. Toe plate 24 has a standard three pin telemark mount for use with a boot having three pin holes in its toe. After the toe of the boot is inserted on the three pins 26, clamp 28 is rotated down around rivets 30 against the flange of the toe of the boot until tongue 32 engages catch 34 which is mounted on axle 36 thereby securing the boot on the toe plate 24 in a manner well known in the art. Prior to the present invention, toe plate 24 was attached directly to the ski 22 by screws such as the three wood screws 38 passing through three mounting holes at the positions shown by the countersinks 80.

In the present invention, a release plate 40 is added between the toe plate 24 and the ski 22. The release plate is secured to the ski by the wood screws 38 instead of the toe plate of the prior method. The toe plate is held on the release plate by a load spool 50 added to the substantially planar bottom surface of the toe plate using a machine screw 52. The load spool is mounted with its longitudinal axis 66 (FIG. 3) substantially perpendicular to the bottom surface of the toe plate. Inside the release plate is a load spring 44 which grabs onto the load spool to retain the toe plate on the ski. The release plate is preferably only one-quarter inch thick which is an additional height not usually noticeable by a skier.

Figure 2:
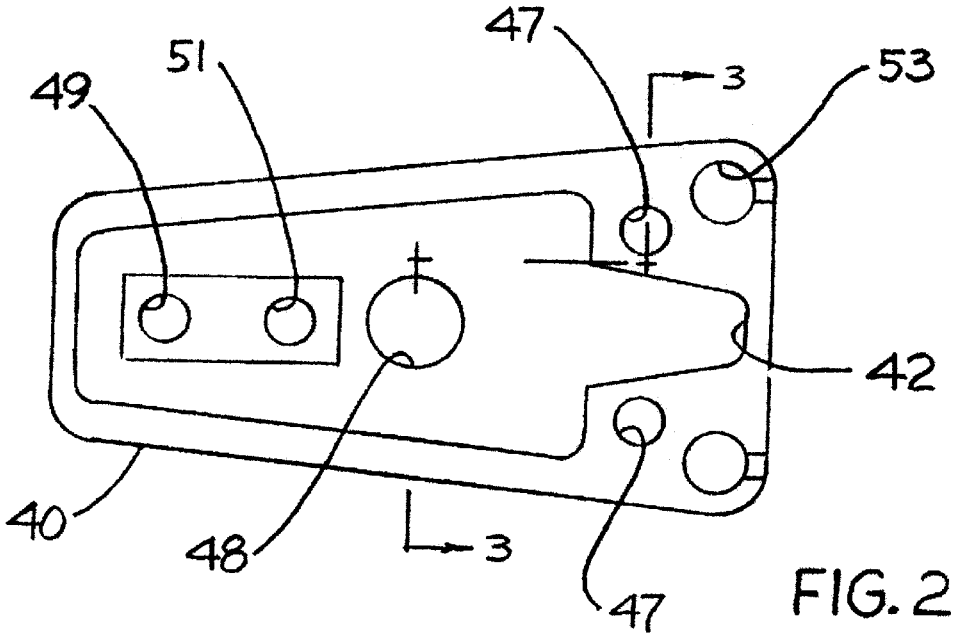
FIG. 2 is bottom plan view of the release plate.
Figure 3:
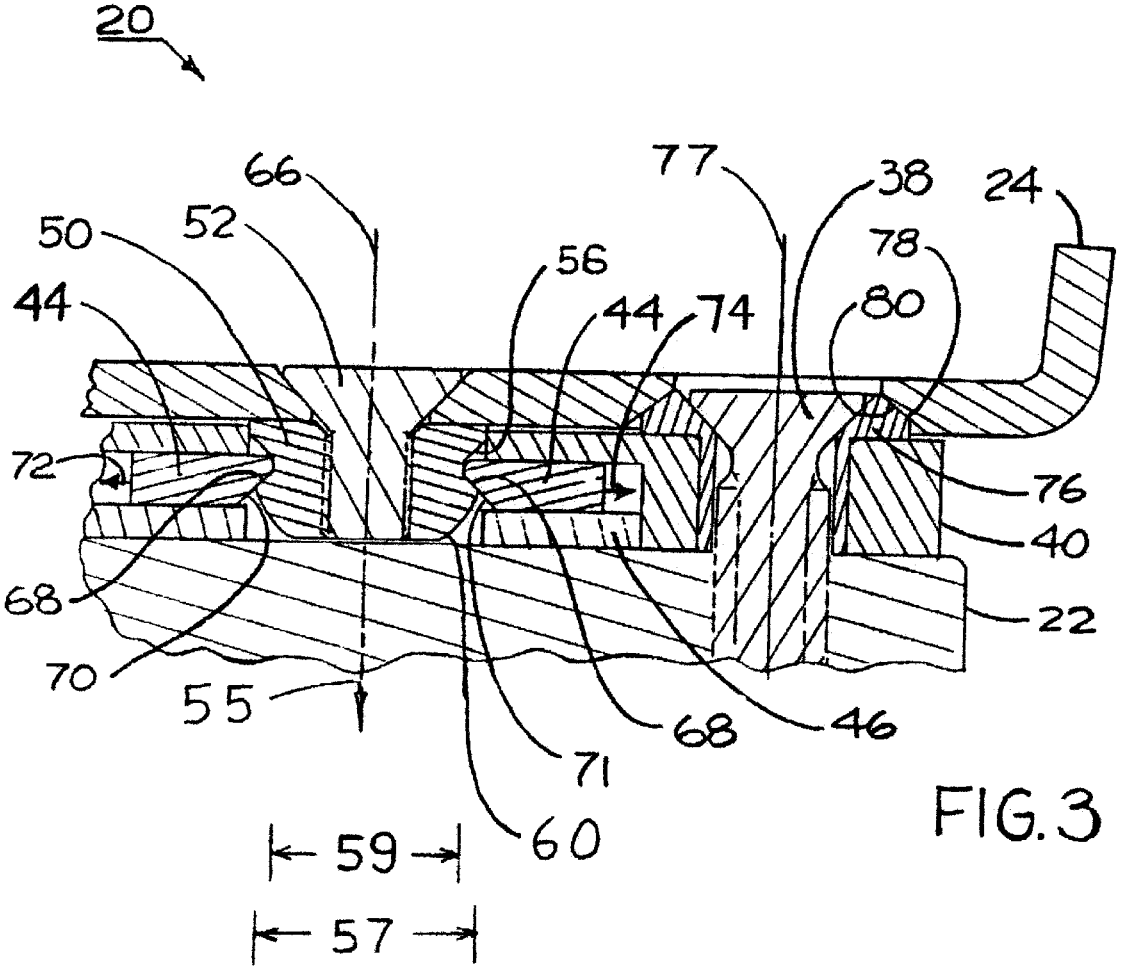
FIG. 3 is a sectional view of the release binding of FIG. 1 assembled on the ski substantially along line 3—3 of FIG. 2.

FIG. 2 is a bottom view of release plate 40. A hollow 42 is created for holding the load spring 44 and a plastic spacer 46 (FIG. 1). The spring and spacer surround a hole 48 in the top of the release plate through which the load spool passes. The spacer is provided with a clearance hole 54 for the bottom end of the spool as shown in FIG. 3. Two aft mounting holes 47 and a fore mounting hole 49 spaced 64 mm. from the aft holes provide mounting holes for the plate in the standard three screw telemark norm. An additional fore mounting hole 51 spaced 47 mm. from the aft screw holes 47 allows a standard three screw cross-country pattern if desired. Two end holes with notches 53 in the release plate are for the attachment of an anchor cord 82 (FIG. 1) discussed below. The overall arrangement of the release binding 20 allows it to be substituted on a telemark or cross-country ski by removing the old binding and installing the release binding on the ski without changing the original screw holes.

FIG. 3 is a sectional view of the release binding 20 of FIG. 1 assembled on the ski 22 substantially along line 3—3 of the release plate 40 of FIG. 2. The load spool 50 is engaged in the load spring 44 retaining the toe plate 24 on the ski. The load spool is mounted with its longitudinal axis 66 perpendicular to the planar bottom surface of the toe plate 24. The release plate 40 holds the load spring 44 so that the plane of the load spring is perpendicular to the longitudinal axis 66 of the load spool.

When the skier wants to install the toe plate 24 on the ski 22 as shown in FIG. 3, he first clamps his boot in the toe plate in the manner described above. He then inserts the load spool 50 into the hole 48 (FIG. 1) in the release plate 40 and steps down in the direction of arrow 55 against the load spring 44. In the process, the pilot surface 60 of the load spool pushes apart the two sides 62 and 64 of the load spring 44 in the directions of the arrows 72 and 74, respectively, allowing the load spool to pass through the spring. The sides of the spring then resiliently snap into the groove 56 of the load spool 50 to retain the toe plate 24 on the ski 22. The load spool passes into the hole 54 (FIG. 1) in the plastic spacer 46 without touching the ski 22. The force required to push the load spool into the spring is dependent upon the strength of the spring and the shape of the pilot surface 60 of the spool.

The load spring 44 is made of hardened stainless steel, preferably type 410 heat treated to hardness C-45, having a spring constant greater than 1000 pounds per square inch and preferably 2500 pounds per inch. It is substantially planar being about 3.5 inches long and 1.0 inch wide and has a constant thickness except in the engagement area 58. It is free to displace horizontally interior to the release plate as shown by the arrows 72 and 74 and is held from vertical movement inside the release plate 40 by the release plate on the top and the plastic spacer 46 on the bottom. The load spring is split into two opposing sides 62 and 64 coupled together at both ends (FIG. 1) defining an elongated central aperture so that when the spool is inserted, each side displaces equally. When the spring is unflexed as shown in FIG. 1, the two opposing sides in the engagement area 58 are spaced a distance less than the second distance 59 of the groove 56. A spring force of 400 pounds at the maximum has been found to be useful in the present application. Each side of the spring applies 200 pounds to the spool. The spring floats inside the release plate always aligning with the spool.

The load spool is also made of hardened stainless steel, preferably type 410 heat treated to hardness C-45, in order to provide the required mechanical durability and resistance to the elements. It has a substantially cylindrical configuration with a longitudinal axis 66, a mounting end adjacent the bottom surface of the toe plate 24, an insertion end spaced from the mounting end, a circumferential groove 56, and a pilot surface 60 having increasing diameters from the insertion end to the groove. The pilot surface has a maximum first diameter of 57 which is greater than the second diameter 59 of the groove. As the pilot surface 60 of the spool 50 engages and displaces the spring, the opposing force from the spring increases as the spring displacement increases until the maximum diameter 57, for example 0.465 inch for a heavy skier, is reached. The pilot is a compound shape which diminishes in sliding angle as it is inserted into the spring until, at the maximum displacement 57, the conical half-angle is less than 20° and is preferably substantially only 10°. This means that if the spring force is 400 pounds, the engagement force applied at right angles to the spring force is only 110 pounds. If desired, a smaller diameter spool having the same pilot profile can be substituted allowing easier engagement for smaller skiers without the need for changing the load spring. For example, by substituting a medium sized spool having a maximum diameter of 0.450 inch, the engagement force is reduced to 100 pounds for use by a medium skier. If a small sized spool having a maximum diameter of 0.435 inch is substituted, the engagement force is reduced to 90 pounds for use by a light skier. A characteristic mark made by scoring the metal or application of different colors of paint may be applied to the top or other portions of the load spool 50 during manufacture to identify the load range of each particular spool. A skier can then easily select a spool having the desired load range from among several spools having different load ranges for installation in the release binding.

Orientation of the release binding 20 on the ski is provided by means of three guides 76 (see also FIG. 1) preferably fabricated of type 303 stainless steel for resistance to the elements mounted through release plate 40 to ski 22 on screws 38. The conical guide is coupled to the release plate with its longitudinal axis 77 perpendicular to the plane of the release plate. The three guides have conical surfaces 78, preferably 100°, which nest in coaxial countersinks 80 having conical surface of preferably 260° beneath the toe plate 24. The countersinks 80 are held on the conical surfaces 78 by the load spring pulling down on the load spool. This pulling action is achieved by providing complementary 45° surfaces on the spring and spool which translate the horizontal spring resilience to a vertical force. Each of the sides of the spring 62 and 64 in the engagement area 58 have upward slopes 70 and 71 preferably at substantially 45° to the plane of the spring. The groove 56 of the load spool has a downward sloped bottom side 68 preferably at 45° to the longitudinal axis 66 of the spool. Then when the spring squeezes the spool in the horizontal plane, the force pushes upward slopes 70 and 71 against downward slope 68 pulling the spool down until the edges of the spring abut the bottom of the groove and/or the conical surfaces 78 of the three guides 76 nest in the countersinks 80 underneath the toe plate 24. The spring holding force which holds the binding to the ski on the three conical guides 76 is about half the total spring force or 200 pounds because of the 45° mating surfaces.

When a skier pulls on the toe plate during a fall or other maneuver, the spool 50 is pulled upward causing the sloped side 68 of the groove 56 to push out the sloped sides 70 and 71 of the two sides 62 and 64 of the spring 44 in the direction of the arrows 72 and 74, respectively. If the force exerted by the skier is not sufficient to pull the load spool all of the way out of the spring, the resilience of the spring in the directions opposite the arrows 72 and 74 pushes the load spool back down into the position shown in FIG. 3 with the toe plate held on the ski. If the force exerted by the skier is sufficient to pull the spool entirely out of the spring, the skier is released from the ski.

More force is required to pull the spool out of the spring than to push the spool into the spring because of the shape of the spool. Entry of the spool into the spring is facilitated by the pilot shape of the spool as noted above. When the spool is being pulled out of the spring, the vertical angle of the pull is translated to the horizontal pushing of the sides of the spring in accordance with the angle between the mating surfaces. In the above example, the angles of the upward slopes 70 and 71 of the spring and the downward slope of the bottom side 68 of the groove 56 of the spool are 45° resulting in a separating load of from 240 to 400 pounds being required to pull the spring and spool apart depending upon the diameter of the spool. In the case of a torsional twisting load, a camming action pull apart load is created between the conical guides 76 and the countersinks 80. The three conical guides are spaced at a radius of 1.3 inches from the load spool and resist rotation until the load spool clamping force is overcome by external torque through the binding from the skier's leg. The exact load values at which release occurs depends upon the diameter of the spool. Torsional twisting loads of from 260 to 440 inch pounds cause the toe plate to cam the spool off the spring as the countersinks 80 ride up on the conical guides 76 separating the toe plate from the ski.

When a skier loses a ski after a release, an anchor cord 82 (FIG. 1) mounted to the release plate 40 by two knotted ends in notched holes 53 and clipped to the skier's boot using fastener 84 keeps the ski from running away down a ski slope. A spring activated ski brake could also be used to prevent a runaway ski.

Figure 4:
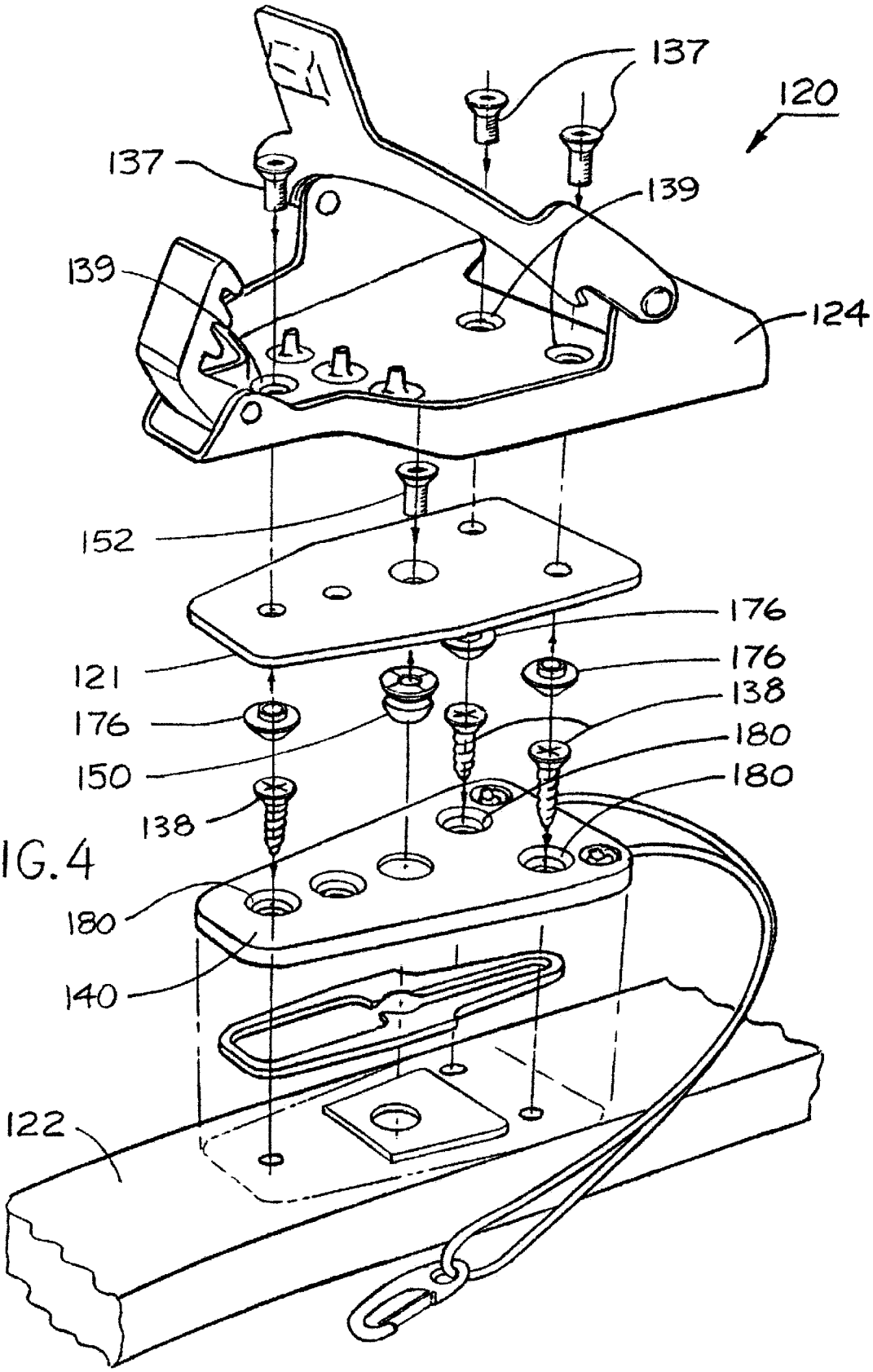
FIG. 4 is an exploded top front left side perspective view of a second embodiment having an adapter plate.

FIG. 4 is an exploded top front left side perspective view of a second embodiment of the release binding, generally designated 120, having an adapter plate 121 between the toe plate 124 and the ski 122. The adapter plate allows a standard toe plate to be used without modification while adding only about one-eighth inch to the overall height of the binding. In this embodiment, the adapter plate 121 carries the load spool 150 secured to it by a machine screw 152. The toe plate 124 is attached to the adapter plate by machine screws 137 passing through mounting holes 139 in the toe plate into conical guides 176. The mounting holes 139 in the toe plate are unmodified unlike the previous embodiment and are positioned in the standard telemark or cross country norm pattern. In this embodiment, the conical guides are inverted from the previous embodiment but are in the same relative locations. The release plate 140 is modified to have the matching countersinks 180 for the conical guides 176 under the adapter plate 121. All other features of embodiment 120 are the same as those of embodiment 20 shown in FIG. 1 and work in the same manner.

Figure 5:
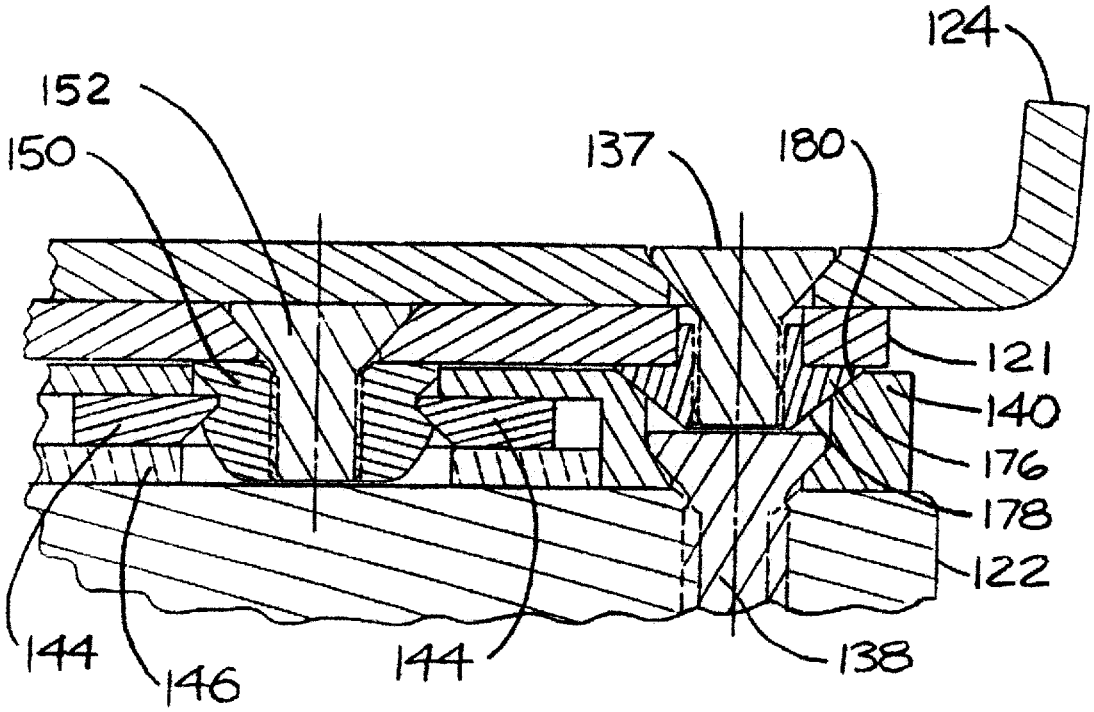
FIG. 5 is a sectional view similar to FIG. 3 of the release binding and adapter plate of FIG. 4 assembled on the ski.

FIG. 5 is a sectional view similar to FIG. 3 of the release binding 120 and adapter plate 121 of FIG. 4 assembled on the ski 122. The toe plate 124 is attached to the adapter plate by machine screws 137 which screw into conical guides 176 (see also FIG. 4). In this embodiment, the conical surfaces 178 face downward instead of upward as in the previous embodiment. Corresponding coaxial countersinks 180 are positioned beneath the conical guides in the release plate 140. The load spool 150 is attached to the bottom of the adapter plate by the machine screw 152 and engages the load spring 144 in exactly the same manner as in the previous embodiment. The release plate 140 is attached to the ski by wood screws 138. All other features of embodiment 120 are the same as those of embodiment 20 shown in FIG. 3 and work in the same manner.

Figure 6:
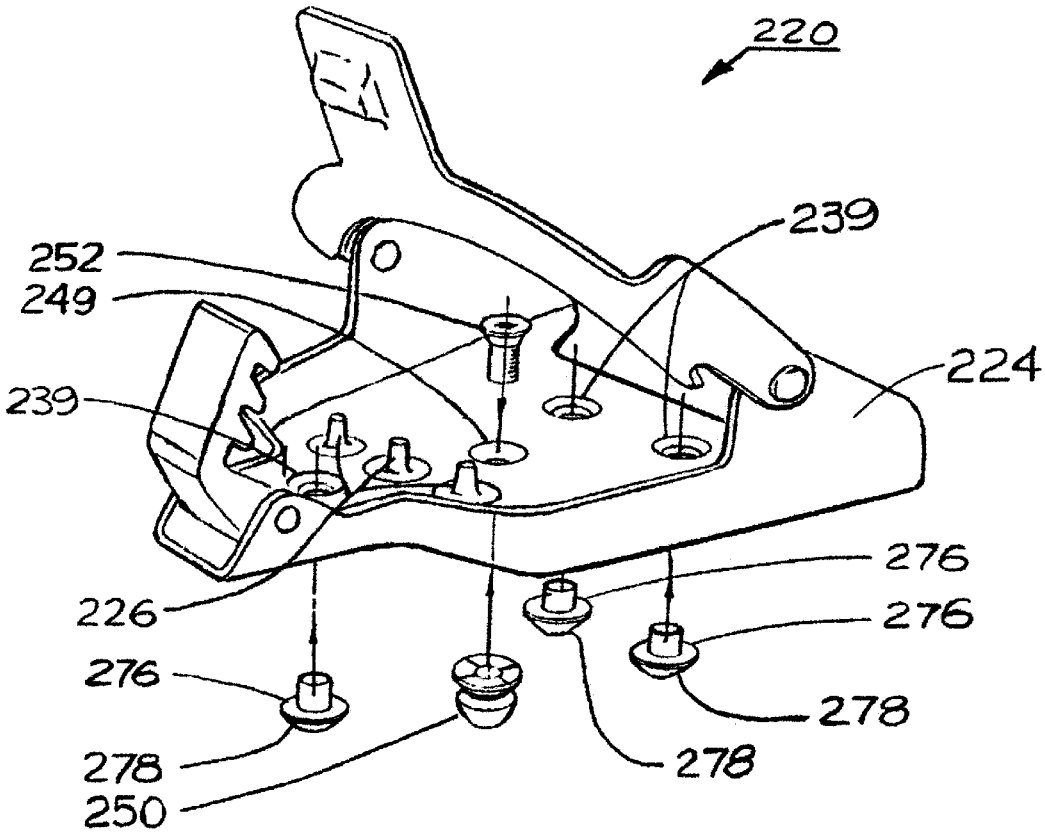
FIG. 6 is an exploded top front left side perspective view of a third embodiment having the conical guides riveted to the toe plate.
Figure 6:
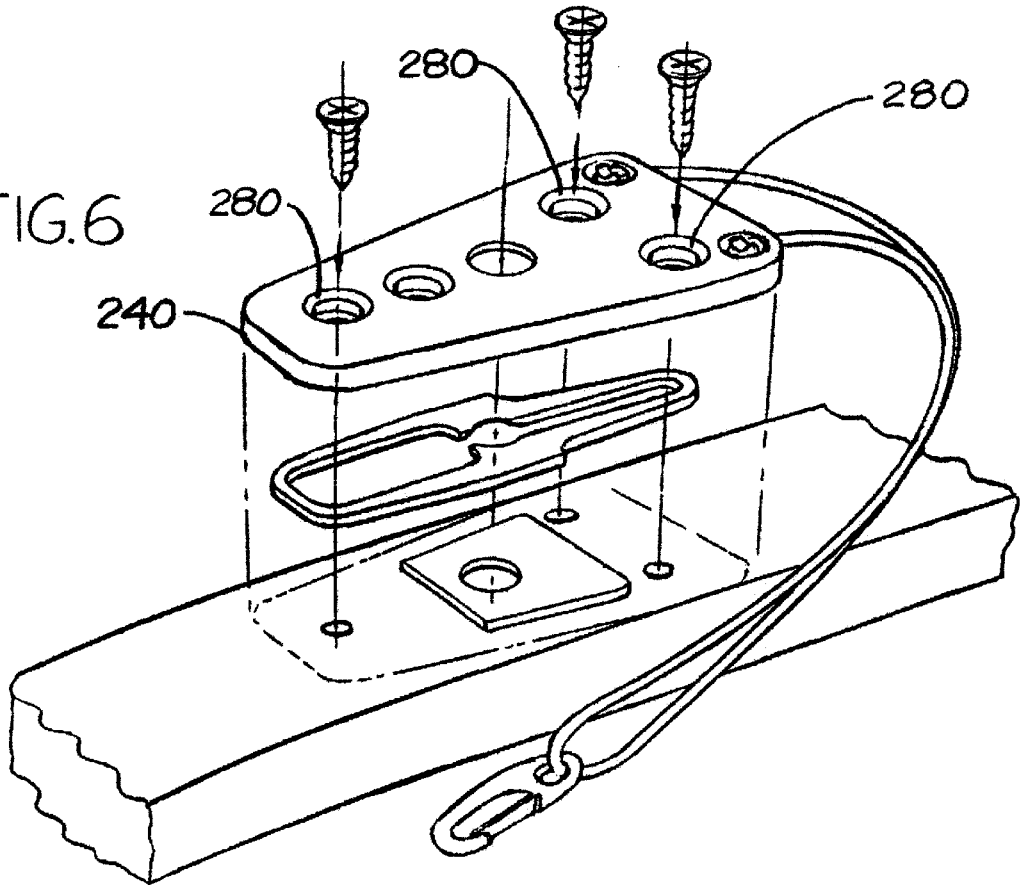

FIG. 6 is an exploded top front left side perspective view of a third embodiment of the release binding, generally designated 220. Release binding 20 illustrated in FIGS. 1–3 is fabricated by making many modifications to a standard toe plate 24. Release binding 120 illustrated in FIGS. 4 and 5 is fabricated by making no modifications to a standard toe plate 124. The release binding 220 of the third embodiment minimizes the modifications required to a standard toe plate 224 while eliminating the need for an adapter plate such as the adapter plate 121 of the second embodiment 120 shown in FIGS. 4 and 5. Three conical guides 276 are riveted or otherwise secured to the toe plate 224 through the standard mounting holes 239 without modification. Toe plate 224 is modified only by providing a hole 249 through the middle of the bottom for a machine screw 252 for securing load spool 250. The conical surfaces 278 of the three conical guides 276 face downward as in the second embodiment and are positioned in corresponding coaxial countersinks 280 in the release plate 240. All other features and operation of the release binding 220 remain the same as in the first embodiment of FIGS. 1–3.

Figure 7:
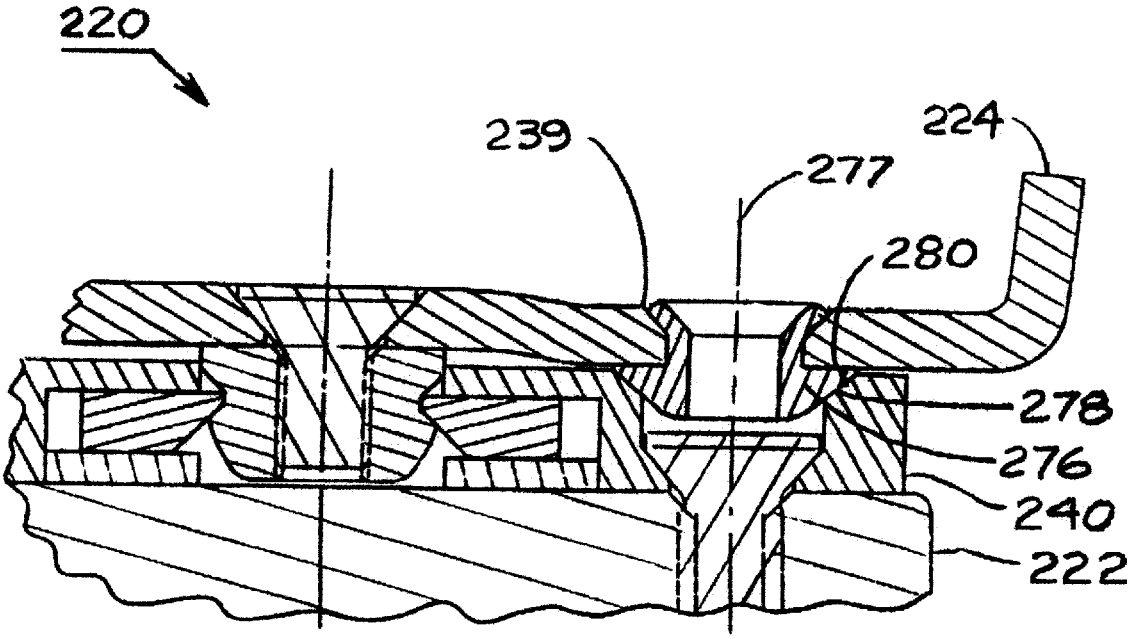
FIG. 7 is a sectional view similar to FIGS. 3 and 5 of the release binding of FIG. 6 assembled on the ski; and, FIG. 8 is a sectional view similar to FIG. 7 showing a variation of the toe plate.

FIG. 7 is a sectional view similar to FIGS. 3 and 5 of the third embodiment of release binding 220 of FIG. 6 assembled on the ski 222. The toe plate 224 illustrated is sold by Voile under the trademark Black Diamond XCO 75 mm. telemark binding. The three pins 226 shown in FIG. 6 hold the toe of the boot in place in the manner described in the discussion of FIG. 1. Because toe plate 224 has a substantially flat bottom, conical guide 276 is preferably riveted to toe plate 224 through hole 239 because the guide has little depth for the threads required for a machine screw. The conical guide is coupled to the toe plate with its longitudinal axis 277 perpendicular to the bottom of the toe plate. Conical surface 278 of the guide faces downward and is coaxial with countersink 280 in release plate 240.

Figure 8:
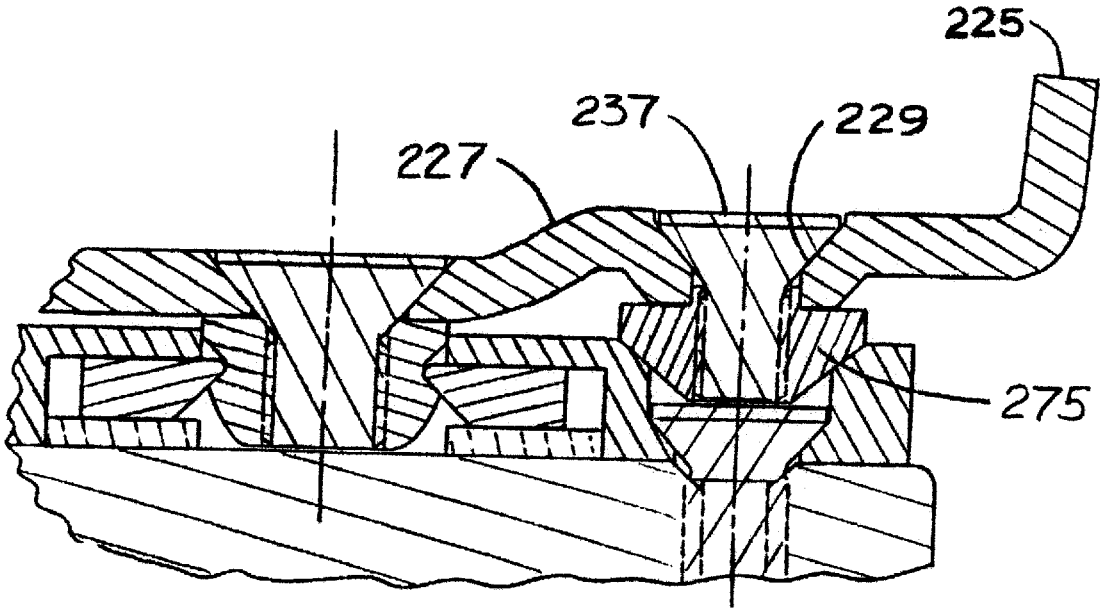

FIG. 8 is a sectional view similar to FIG. 7 showing a variation of a toe plate not having a substantially flat bottom. Toe plate 225 illustrated in FIG. 8 is sold by Voile under the trademark Black Diamond Riva cable binding. A cable passes from the front of one side of toe plate 225 along the sides of the toe plate and ski boot, around the heal of the boot, and then back along the other side of the ski boot and toe plate to the other side of the front of the toe plate. The raised side 227 of the toe plate allows a deeper countersunk hole 229 than the hole 239 of FIG. 7. Consequently, a slightly longer fastener can be used such as machine screw 237 to hold conical guide 275 in place.

It will be appreciated that the positioning of the load spool and load spring on all of the embodiments illustrated could be reversed with the load spool mounted on the ski and the load spring mounted on the toe plate. Also, the spool, instead of being round, could be rounded in only the areas that contact the load spring and squared off in areas away from the load spring. And the load spring could be fabricated of separate parts with two rods for the sides coupled together at both ends. The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A release binding for mounting a boot to a ski, comprising:

a toe plate for retaining the toe of the boot having a substantially planar bottom surface;

a load spool having a longitudinal axis and a substantially cylindrical exterior surface having a pilot surface with a maximum first diameter and a circumferential groove with a second diameter, said maximum first diameter greater than said second diameter;

said load spool coupled to said bottom surface of said toe plate with said longitudinal axis perpendicular to said planar bottom surface;

a planar load spring having two sides coupled together at both ends defining an elongated central aperture, said two sides spaced from each other in an engagement area when in an unflexed condition a distance less than said second diameter;

said engagement area of said load spring two sides gripping said load spool in said groove; and, a release plate for mounting said release binding on the ski and retaining said load spring with the plane of said load spring perpendicular to said longitudinal axis of said load spool.

2. A release binding according to claim 1, wherein said load spool has a mounting end, an insertion end spaced from said mounting end along said longitudinal axis, and a pilot surface from said insertion end to said groove, said pilot surface having an increasing diameter from said insertion end to said groove beginning with a diameter at said insertion end less than said second diameter.

3. A release binding according to claim 1, wherein said first diameter of said pilot surface adjacent said groove increases at a conical half-angle of less than 20°.

4. A release binding according to claim 3, wherein said first diameter of said pilot surface adjacent said groove increases at a conical half-angle of substantially 10°.

5. A release binding according to claim 1, wherein said groove has a bottom side with a downward slope at an angle of substantially 45° to said longitudinal axis and each of said two sides of said load spring have upward slopes at angles of substantially 45° to said plane of said spring.

6. A release binding according to claim 1, wherein said load spring has a spring constant of greater than 1000 pounds per inch.

7. A release binding according to claim 6, wherein said load spring has a spring constant of substantially 2500 pounds per inch.

8. A release binding according to claim 1, wherein said load spring is fabricated of a single piece of planar steel.

9. A release binding according to claim 1, wherein said load spool is substantially cylindrical, and said release binding further including a means for orienting said toe plate on said release plate.

10. A release binding according to claim 9, wherein said orienting means includes:

at least one conical guide having a longitudinal axis, said at least one conical guide coupled to one of said toe plate bottom surface with said longitudinal axis perpendicular to said bottom surface and said release plate with said longitudinal axis perpendicular to said release plate; and, a countersink in the other of said toe plate and said release plate coaxial with each of said at least one conical guide.

11. A release binding according to claim 10, wherein said at least one conical guide has a substantially 100° conical surface and said coaxial countersink has a substantially 260° nesting conical surface.

12. A release binding according to claim 1, further including an adapter plate coupled to said toe plate, wherein said load spool is coupled to said adapter plate.

13. A release binding according to claim 12, wherein said load spool is substantially cylindrical, and said release binding further including a means for orienting said adapter plate on said release plate.

14. A release binding according to claim 13, wherein said adapter plate orienting means includes:

at least one conical guide having a longitudinal axis, said at least one conical guide coupled to one of said adapter plate with said longitudinal axis perpendicular to said adapter plate and said release plate with said longitudinal axis perpendicular to said release plate; and, a countersink in the other of said adapter plate and said release plate coaxial with each of said at least one conical guide.

15. A release binding according to claim 14, wherein said at least one conical guide has a substantially 100° conical surface and said coaxial countersink has a substantially 260° nesting conical surface.

* * * * *